US010714007B2

(12) United States Patent
Xu

(10) Patent No.: US 10,714,007 B2
(45) Date of Patent: Jul. 14, 2020

(54) PIXEL CIRCUIT AND DRIVING METHOD THEREFOR, AND DISPLAY APPARATUS

(71) Applicants: CHENGDU BOE OPTOELECTRONICS TECHNOLOGY CO., LTD., Chengdu, Sichuan (CN); BOE TECHNOLOGY GROUP CO., LTD., Beijing (CN)

(72) Inventor: Yingsong Xu, Beijing (CN)

(73) Assignees: CHENGDU BOE OPTOELECTRONICS TECHNOLOGY CO., LTD., Chengdu, Sichuan (CN); BOE TECHNOLOGY GROUP CO., LTD., Beijing (CN)

( * ) Notice: Subject to any disclaimer, the term of this patent is extended or adjusted under 35 U.S.C. 154(b) by 1 day.

(21) Appl. No.: 16/329,503

(22) PCT Filed: May 9, 2018

(86) PCT No.: PCT/CN2018/086137
§ 371 (c)(1),
(2) Date: Feb. 28, 2019

(87) PCT Pub. No.: WO2018/223799
PCT Pub. Date: Dec. 13, 2018

(65) Prior Publication Data

US 2019/0259332 A1 Aug. 22, 2019

(30) Foreign Application Priority Data

Jun. 9, 2017 (CN) ..... 2017 1 0433288

(51) Int. Cl.
*G09G 3/3233* (2016.01)
*G09G 3/3208* (2016.01)
*G09G 3/3266* (2016.01)

(52) U.S. Cl.
CPC ..... *G09G 3/3233* (2013.01); *G09G 3/3208* (2013.01); *G09G 3/3266* (2013.01);
(Continued)

(58) Field of Classification Search
CPC ... G09G 3/30–3291; G09G 2300/0426; G09G 2300/0842; G09G 2300/0819;
(Continued)

(56) References Cited

U.S. PATENT DOCUMENTS

2004/0041750 A1* 3/2004 Abe ..... G09G 3/3233 345/76
2004/0257353 A1* 12/2004 Imamura ..... G09G 3/3233 345/204

(Continued)

FOREIGN PATENT DOCUMENTS

CN 103021338 A 4/2013
CN 104318897 A 1/2015

(Continued)

OTHER PUBLICATIONS

International Search Report and Written Opinion dated Aug. 17, 2018; PCT/CN2018/086137.

*Primary Examiner* — David Tung

(57) ABSTRACT

Provided is a pixel circuit, including: a data writing unit, a driving unit, a reset unit, a light emission control unit, a storage unit and a light-emitting unit, wherein the data writing unit is configured to write a data signal input by a data signal line into a first mode; the reset unit is configured to reset the data signal and write the data signal into an output terminal of the driving unit; the storage unit is configured to store information on the data signal and transfer it to the driving unit; and the light emission control unit is configured to write a second power supply voltage at a second power supply voltage terminal into the reset unit (Continued)

and provide a light emission current to the light-emitting unit.

20 Claims, 6 Drawing Sheets

(52) U.S. Cl.
CPC ..... *G09G 2300/0426* (2013.01); *G09G 2300/0842* (2013.01); *G09G 2320/0233* (2013.01); *G09G 2320/045* (2013.01); *G09G 2330/028* (2013.01)

(58) Field of Classification Search
CPC ... G09G 2300/0814; G09G 2320/0233; G09G 2320/045; G09G 2310/0251; G09G 2330/028
See application file for complete search history.

(56) References Cited

U.S. PATENT DOCUMENTS

| | | | | |
|---|---|---|---|---|
| 2006/0139253 | A1* | 6/2006 | Choi | G09G 3/3233 345/76 |
| 2008/0100545 | A1* | 5/2008 | Hong | G09G 3/325 345/82 |
| 2011/0018858 | A1* | 1/2011 | Ryu | G09G 3/3291 345/213 |
| 2014/0375533 | A1* | 12/2014 | Kim | G09G 3/3233 345/78 |
| 2016/0274719 | A1 | 9/2016 | Yang et al. | |
| 2016/0284280 | A1 | 9/2016 | Mu et al. | |
| 2018/0261155 | A1* | 9/2018 | Ota | H01L 51/5221 |

FOREIGN PATENT DOCUMENTS

| | | | |
|---|---|---|---|
| CN | 104537983 | A | 4/2015 |
| CN | 107274828 | A | 10/2017 |
| JP | 2016-109911 | A | 6/2016 |

* cited by examiner

PIXEL CIRCUIT AND DRIVING METHOD THEREFOR, AND DISPLAY APPARATUS

CROSS-REFERENCE TO RELATED APPLICATION

The present application claims the priority of a Chinese patent application No, 201710433288.5 filed on Jun. 9, 2017, with an invention title of "PIXEL CIRCUIT AND DRIVING METHOD THEREOF, AND DISPLAY APPARATUS". Herein, the content disclosed by the Chinese patent application is incorporated in full by reference as a part of the present application.

TECHNICAL FIELD

The present disclosure relates to a field of display technique, in particular to a pixel circuit and a driving method therefor, a display apparatus.

BACKGROUND

In recent years, owning to excellent display effect of an organic light emitting diode (OLED) display, development of OLED-related industry at home and abroad is booming, and various pixel circuits have been developed one after another.

In the process of practical production and fabrication for thin film transistors (TFTs), excimer laser annealing (ELA) and doping processes cannot guarantee that the TFTs have good a uniformity, which results in the occurrence of threshold voltage deviation and mobility deviation, wherein the mobility is related to μ in a current formula. For a most basic 2T1C (two TFTs having a function of switching, and one capacitor having a function of storing charges) circuit, when a same data signal (Data) is written, brightness of respective pixels would be non-uniform due to different Vth and μ existing in the current formula, thereby causing problems of bad display, and influencing the display effect of the OLED display.

SUMMARY

There is provided in an embodiment of the present disclosure a pixel circuit and a driving method thereof, and a display apparatus, which can improve brightness non-uniformity of the display apparatus caused by influence of threshold voltage and mobility, and can compensate for a problem of brightness reduction caused by OLED aging.

According to a first aspect, there is provided a pixel circuit, comprising a data writing unit, a driving unit, a reset unit, a light emission control unit, a light-emitting unit and a storage unit, wherein the data writing unit is connected to a data signal line, a first scanning line and a first node, and configured to write a data signal input by the data signal line into the first node under a control of a first scanning signal of the first scanning line; the reset unit is connected to the data signal line, the first scanning line and an output terminal of the driving unit, and configured to reset the data signal input by the data signal line and write the data signal into the output terminal of the driving unit, under the control of the first scanning signal; the storage unit includes one terminal connected to a control terminal of the driving unit, and another terminal connected to an input terminal of the driving unit and a first power supply voltage terminal, and is configured to store information on the data signal and transfer it to the control terminal of the driving unit; the light emission control unit is connected to the output terminal of the driving unit, the light-emitting unit, a second scanning line, a third scanning line and a second power supply voltage terminal, and configured to write a second power supply voltage of the second power supply voltage terminal into the reset unit and provide a light emission current to the light-emitting unit to control the fight-emitting unit to emit light, under a control of a second scanning signal of the second scanning line and a third scanning signal of the third scanning line; an output terminal of the light-emitting unit is connected to the second power supply voltage terminal.

In one embodiment, the pixel circuit further comprises a compensation unit, connected to the first node, the control terminal of the driving unit and a fourth scanning line, and configured to write a voltage of the first node into the control terminal of the driving unit and compensate for the light emission current under a control of a fourth scanning signal of the fourth scanning line.

In one embodiment, the compensation unit is further connected to an input terminal of the light-emitting unit.

In one embodiment, the first scanning line and the second scanning line are a same signal line or two different signal lines.

According to a second aspect, there is provided a driving method for the pixel circuit as described in the first aspect, comprising: a first phase, writing information on a data signal input by the data signal line to the driving unit; a second phase, resetting an input terminal of the light-emitting unit; a third phase, providing a light emission current to the light-emitting unit to control the light-emitting unit to emit light.

In one embodiment, the pixel circuit further comprises a compensation unit, the driving method further comprising: in the second phase, resetting the data signal input by the data signal line while resetting an input terminal of the light-emitting unit; in the third phase, compensating for the light emission current.

According to a third aspect, there is provided a driving circuit, comprising a plurality of pixel circuits as described in the first aspect, the plurality of pixel circuits forming a matrix, wherein in the matrix, a third scanning line of a pixel circuit of a present row and a fourth scanning line of a pixel circuit of a previous row are a same scanning line.

According to a fourth aspect, there is provided a display apparatus for the driving circuit as described in the third aspect.

BRIEF DESCRIPTION OF THE DRAWINGS

By describing preferable embodiments of the present disclosure in detail combined with the accompanying figures, the above and other purposes, characteristics and advantages of the present disclosure will become more clear, wherein same reference marks designate the units having the same structure, and wherein:

FIG. 1(*b*) shows an operation timing diagram of the exemplary circuit of the pixel circuit in FIG. 1(*a*);

FIG. 2(*b*) shows an operation timing diagram of the exemplary circuit of the pixel circuit in FIG. 2(*a*);

FIG. 5(*b*) shows an operation timing diagram of the exemplary circuit of the pixel circuit in FIG. 5(*a*);

FIG. 6(*b*) shows an operation timing diagram of the exemplary circuit of the pixel circuit in FIG. 6(*a*);

DETAILED DESCRIPTION

Figure 1A:
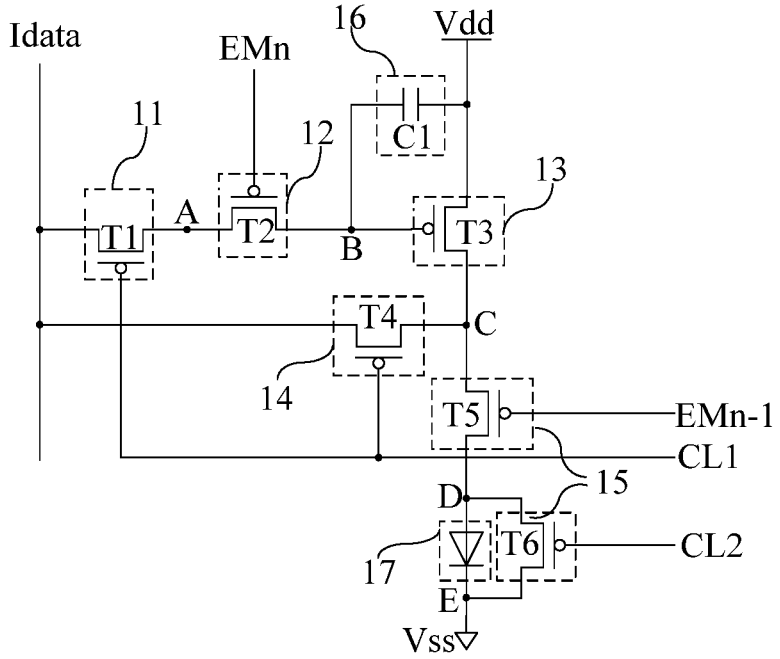
FIG. 1(*a*) shows an exemplary circuit structure diagram of a pixel circuit according to a first embodiment of the present disclosure.

Technical solutions in embodiments of the present disclosure will be described clearly and completely by combining with the accompanying figures in the embodiments of the present disclosure. Obviously, the embodiments described below are just a part of embodiments of the present disclosure, but not all the embodiments. Based on the embodiments in the present disclosure, all the other embodiments obtained by those ordinary skilled in the art without paying any inventive labor belong to the scope sought for protection in the present disclosure.

Transistors adopted in all embodiments of the present disclosure may all be thin film transistors or field effect transistors or other devices having same characteristics. In all the embodiments, connection way of a second electrode and that of a first electrode for each transistor can be exchanged with each other. Therefore, second electrodes and first electrodes of respective transistors in embodiments of the present actually do not have any distinction. Herein, for the purpose of convenient description, one of a second electrode and a first electrode of a transistor is called as the first electrode of the transistor, while another thereof is called as the second electrode of the transistor.

There is provided in an embodiment of the present disclosure a pixel circuit, comprising: a data writing unit, a driving unit, a reset unit, a light emission control unit, a light-emitting unit and a storage unit.

The data writing unit is connected to a data signal line, a first scanning uric and a first node, and configured to write a data signal input by the data signal line into the first node under a control of a first scanning signal of the first scanning line.

The reset unit is connected to the data signal line, the first scanning line and an output terminal of the driving unit, and configured to reset the data signal input by the data signal line and write the data signal into the output terminal of the driving unit under the control of the first scanning signal.

The storage unit includes one terminal connected to a control terminal of the driving unit, and another terminal connected to an input terminal of the driving unit and a first power supply voltage terminal, and configured to store information on the data signal and transfer it to the control terminal of the driving unit.

The light-emitting control unit is connected to the output terminal of the driving unit, the light-emitting unit, a second scanning line, a third scanning line and a second power supply voltage terminal, and configure to write a second power supply voltage of the second power supply voltage terminal into the reset unit and provide a light emission current to the light-emitting unit to control the light-emitting unit to emit light, under a control of a second scanning signal of the second scanning line and a third scanning signal of the third scanning line.

An output terminal of the light-emitting unit is connected to the second power supply voltage terminal.

According to the embodiment of the present disclosure, the pixel circuit further comprises a compensation unit, connected to the first node, the control terminal of the driving unit and a fourth scanning line, and configured to write a voltage of the first node into the control terminal of the driving unit and compensate for the light emission current under a control of a fourth scanning signal of the fourth scanning line.

According to the embodiment of the present disclosure, the compensation unit is further connected to an input terminal of the light-emitting unit.

According to the embodiment of the present disclosure, the first scanning line and the second scanning are a same signal line or two different signal lines.

First and Second Embodiments

Figure 1B:
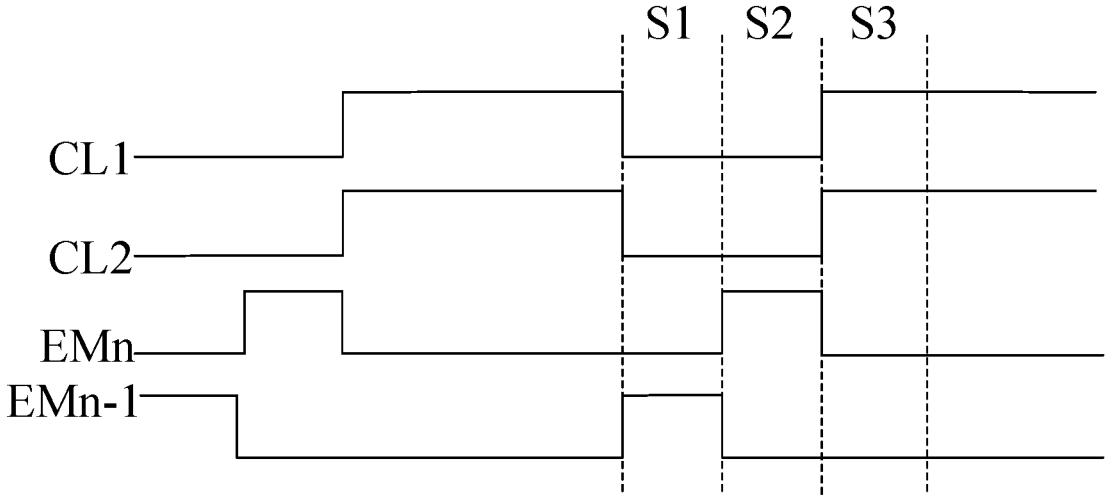

FIGS. 1(*a*) and 2(*a*) show exemplary circuit structure diagrams of pixel circuits according to a first embodiment and a second embodiment of the present disclosure respectively.

The pixel circuits as shown in FIGS. 1(*a*) and 2(*a*) each comprises: a data writing unit 11, a compensation unit 12, a driving unit 13, a reset unit 14, a light emission control unit 15, a storage unit 16 and a light-emitting unit 17.

In the first embodiment as shown in FIG. 1(*a*), the data writing unit 11 is connected to a data signal line Idata, a first scanning line CL1 and a first node A; the compensation unit 12 is connected to the first node A, a second node B and a fourth scanning line EMn; the driving unit 13 is connected to a first power supply voltage terminal Vdd, the second node B and a third node C; the reset unit 14 is connected to the data signal line Idata, the first scanning line CL1 and the third node C; the light emission control unit 15 is connected to the third node C, a third scanning line EMn−1, a second scanning line CL2 and an input terminal D of the light-emitting unit 17 and an output terminal E of the light-emitting unit 17; the output terminal. E of the light-emitting unit 17 is connected to a second power supply voltage terminal Vss; a second terminal of the storage unit 16 is connected to the first power supply voltage terminal Vdd, and a first terminal thereof is connected to the second node B.

In the embodiment, the data writing unit 11 comprises a first switch transistor T1. A gate of the first switch transistor T1 is connected to the first scanning line CL1, a first electrode thereof is connected to the data signal line Idata, and a second electrode thereof is connected to the first node A.

In the embodiment, the compensation unit 12 comprises a second switch transistor T2. A gate of the second switch transistor T2 is connected to the fourth scanning line EMn, a first electrode thereof is connected to the first node A, and a second electrode thereof is connected to the second node B.

In the embodiment, the driving unit 13 comprises a third switch transistor T3. A gate of the third switch transistor T3 is connected to the second node B, a first electrode thereof functions as the input terminal of the driving unit 13 and connected to the first power supply voltage terminal Vdd, and a second electrode thereof functions as the output terminal of the driving unit 13 and connected to the third node C.

In the embodiment, the reset unit 14 comprises a fourth switch transistor T4. A gate of the fourth switch transistor T4 is connected to the first scanning line CL1, a first electrode thereof is connected to the data signal line Idata, and a second electrode thereof is connected to the third node C.

In the embodiment, the light emission control unit 15 comprises a fifth switch transistor T5 and a sixth switch transistor T6. A gate of the fifth switch transistor T5 is connected to the third scanning line EMn−1, a first electrode thereof is connected to the third node C, and a second electrode thereof is connected to the input terminal D of the light-emitting unit 17. A gate of the sixth switch transistor T6 is connected to the second scanning line CL2, a first electrode thereof is connected to the input terminal D of the light-emitting unit 17, and a second electrode thereof is connected to the output terminal E of the light-emitting unit 17.

In the embodiment, the storage unit 16 comprises a first capacitor C1. A first terminal of the first capacitor C1 is connected to the second node B, and a second terminal thereof is connected to the first power supply voltage terminal Vdd.

In the embodiment, the light-emitting unit 17 comprises a light-emitting diode. An anode of the light-emitting, diode functions as the input terminal D of the light-emitting, unit 17, and a cathode thereof functions as the output terminal E of the light-emitting unit 17. An operation timing of the pixel circuit as shown in FIG. 1(*a*) will be described below by referring to FIG. 1(*b*). Herein, FIG. 1(*b*) is described by taking timings of the first scanning line CL1 and the second scanning line CL2 being the same as an example. However, the present disclosure is not limited thereto, and the timings of the first scanning line CL1 and the second scanning line CL2 may be different.

In addition, description is given below by taking all the switch transistors in FIG. 1(*a*) being P type transistors as an example. As well known by those skilled in the art, the P type transistors are turned on when the gate is input a high level.

During a phase S1 in FIG. 1(*b*), the first scanning line CL1, the second scanning line CL2 and the fourth scanning line EMn are at a low level, and the third scanning line EMn−1 are at a high level. The first switch transistor T1 is turned on under a control of a signal of the first scanning line CL1, and writes a data signal input by the data signal line Idata into the first node A. The second switch transistor T2 is turned on under a control of a signal of the fourth scanning line EMn, and writes a data signal of the first node A into the second node B. At this time, the first capacitor C1 stores a voltage difference between the data signal and the first power supply voltage terminal Vdd. The fourth switch transistor T4 is turned on under the control of the first scanning line CL1, and writes the data signal input by the data signal line Idata into the third node C. The fifth switch transistor T5 is turned off under the control of the third scanning line EMn−1. The sixth switch transistor T6 is turned on under the control of the second scanning line CL2, and connects the input terminal D of the light-emitting unit 17 to the second power supply voltage terminal Vss.

During a phase S2 in FIG. 1(*b*), the first scanning line CL1, the second scanning line CL2 and the third scanning line EMn−1 are at the low level, and the fourth scanning line EMn is at the high level. The sixth switch transistor T6 is turned on under the control of the second scanning line CL2, and pulls down a potential of the input terminal D of the light-emitting unit 17 to a second power supply voltage of the second power supply voltage terminal Vss. The fifth switch transistor T5 is turned on under the control of the third scanning line EMn−1, and further pulls down a potential of the third node C to the second power supply voltage. The fourth switch transistor T4 is turned on under the control of the first scanning line CL1, and also pulls down a potential of the data signal line Idata to the second power supply voltage through the third node C, so as to realize resetting a voltage and a parasitic capacitance on the data signal line Idata. In this way, when a next frame comes, a data signal of a previous frame would not be obtained due to the parasitic capacitance on the data signal line Idata, so as to prevent from influencing the display effect. The second switch transistor T2 is turned off under the control of the signal of the fourth scanning line EMn. The first switch transistor T1 is turned on under the control of the signal of the first scanning line CL1, and writes the reset data signal line Idata into the first node. Thus, when a next frame comes, the potential of the second node B would be pulled down through the second switch transistor T2 in the phase S1 of the next frame, so as to guarantee that the third switch transistor T3 can be turned on at the next frame, thereby guaranteeing that the second node B can obtain a voltage corresponding to a current on the data signal line Idata.

During a phase S3 in FIG. 1(*b*), the first scanning line CL1 and the second scanning line CL2 are at the high level, and the third scanning line EMn−1 and the fourth scanning line EMn are at the low level. The first switch transistor T1 is turned off under the control of the signal of the first scanning line CL1. The fourth switch transistor T4 is turned off under the control of the first scanning line CL1. The sixth switch transistor T6 is turned off under the control of the second scanning line CL2. The fifth switch transistor T5 is turned on under the control of the third scanning line EMn−1, and provides a light emission current output from the driving unit 13 to the input terminal of the light-emitting unit 17, so as to make it emit light. The second switch transistor T2 provides the voltage of the first node A to the second node B under the control of the signal of the fourth scanning line EMn. At this time, the first capacitor C1 stores the potential of the second node B.

During the actual process of displaying, when the data signal input by the data signal line Idata is written into the second node B, that is, when the current on the data signal Idata flows through the second node B, the driving unit 13 obtains a voltage value Vg. In a data writing phase, i.e., the phase S1, the voltage value Vg satisfies:

$$I = \frac{1}{2}\mu Cox\frac{W}{L}(Vg - Vdd - Vth)^2,$$

where I is a current written by the data signal line Idata, $$\frac{1}{2}\mu Cox\frac{W}{L}$$

may be considered as a constant K, Vth is a threshold voltage of the driving unit 13. In a light-emitting phase, i.e., the phase S3, $$Vg = Vdd + Vth + \sqrt{\frac{I}{K}},$$

and thus it can be derived that $$Vgs = Vg - Vdd = Vth + \sqrt{\frac{I}{K}}.$$

According to a current formula $I=K(Vgs-Vth)^2$, it can be known that at this time, a current flowing though the light-emitting unit 17 is the current I written by the data signal line Idata, thereby being independent of Vth and μ, that is, the current used for making the light-emitting unit 17 emit light is not affected by the threshold voltage and mobility. If the pixel circuit is applied to a display apparatus, the phenomenon of brightness non-uniformity upon displaying of the display apparatus caused by instability of the threshold voltage or the mobility can be improved.

Figure 2A:
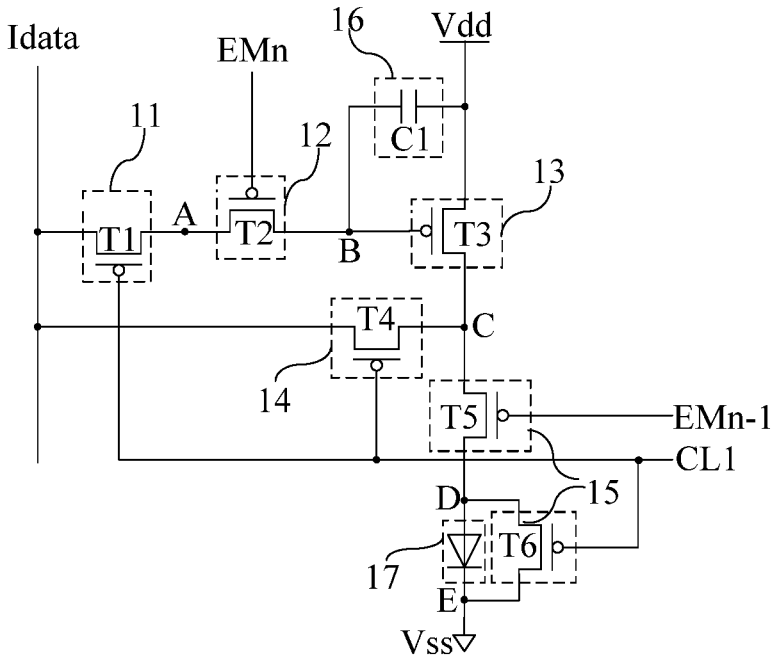
FIG. 2(*a*) shows an exemplary circuit structure diagram of a pixel circuit according to a second embodiment of the present disclosure.
Figure 2B:
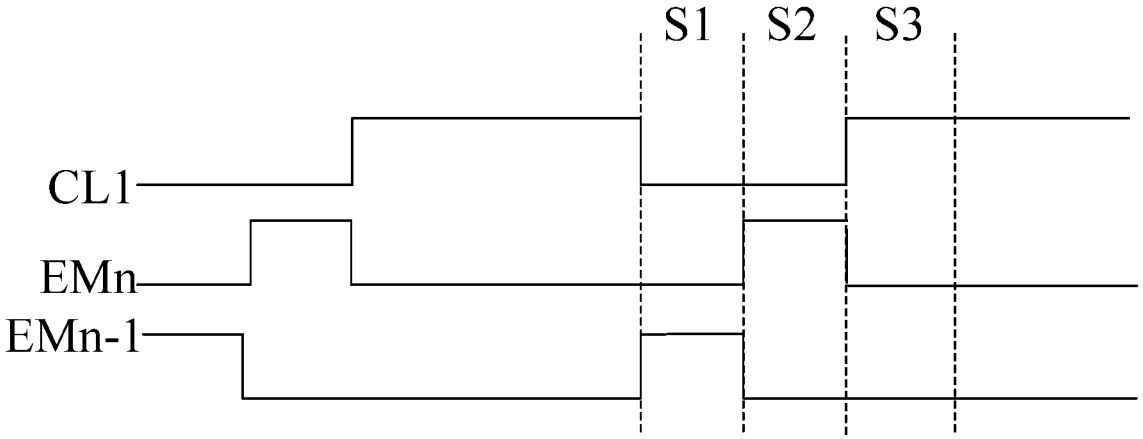

A circuit structure of a pixel circuit of the second embodiment as shown in FIG. 2(*a*) is basically the same as the circuit structure of the pixel circuit of the first embodiment as shown in FIG. 1(*a*), and thus no further details are provided herein. The only difference between the first embodiment and the second embodiment lies in that: in the first embodiment, the first scanning line and the second scanning line are two different separate signal lines, i.e., CL1 and CL2 respectively, wherein a timing of the CL2 may be the same as or different from that of the CL1; however, in the second embodiment, the first scanning line and the second scanning line are a same signal line, i.e., CL1.

Compared with the second embodiment, an advantage of the first embodiment is that whether the light-emitting unit 17 emits light can be controlled individually by controlling a gate potential of the second scanning line CL2, and even if the fifth switch transistor T5 is in a turn-on state at this time and the pixel circuit is in the light-emitting phase, the second scanning line CL2 can also be controlled to adjust light emission of the light-emitting unit, for the purpose of adjusting brightness and contrast. Compared with the first embodiment, an advantage of the second embodiment is that one scanning line is saved. Therefore, the second embodiment has an effect of simplifying the design.

Since the operation timing of the pixel circuit in the first embodiment as shown in FIG. 1(*a*) when timings of the first scanning line CL1 and the second scanning line CL2 are the same is the same as the operation timing of the pixel circuit in the second embodiment as shown in FIG. 2(*a*). Therefore, the specific timing of the pixel circuit in the second embodiment as shown in FIG. 2(*b*) can in particular refer to the phases S1-S3 with respect to description of FIG. 1(*b*).

Third and Fourth Embodiments

Figure 3:
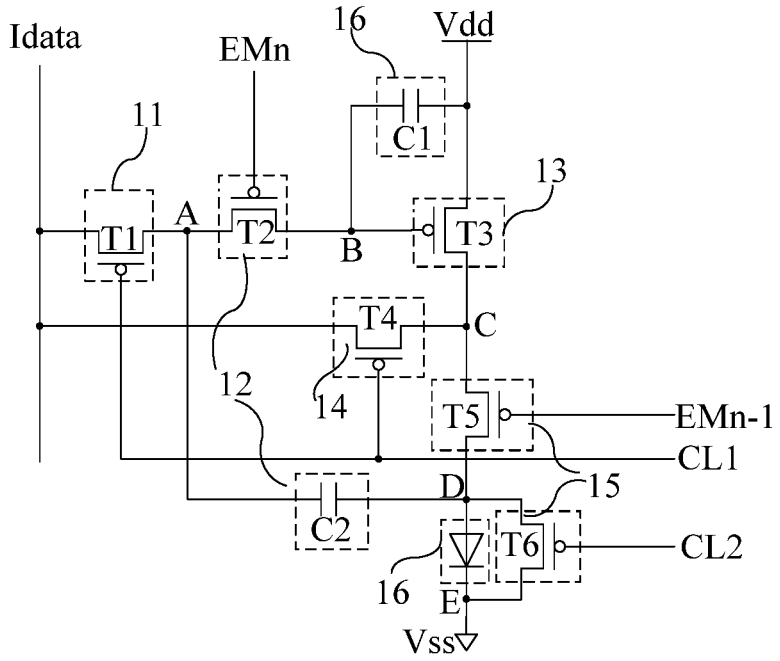
FIG. 3 shows an exemplary circuit structure diagram of a pixel circuit according to a third embodiment of the present disclosure.
Figure 4:
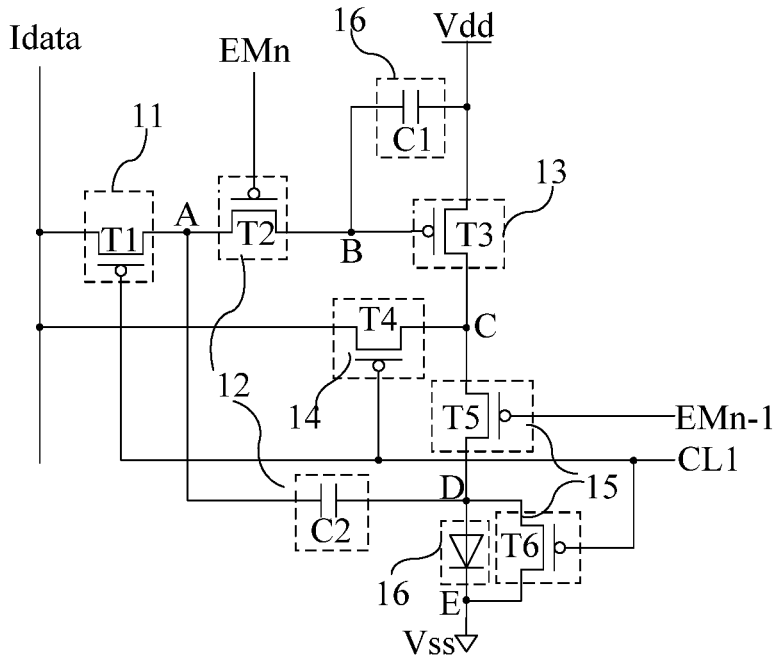
FIG. 4 shows an exemplary circuit structure diagram of a pixel circuit according to a fourth embodiment of the present disclosure.

FIG. 3 and FIG. 4 show exemplary circuit structure diagrams of pixel circuits according to the third embodiment and the fourth embodiment of the present disclosure respectively.

In particular, as shown in FIG. 3, a second capacitor C2 is added to the compensation unit 12 on the basis of the pixel circuit as shown in FIG. 1(*a*), and as shown in FIG. 4, the second capacitor C2 is added to the compensation unit 12 on the basis of the pixel circuit as shown in FIG. 2(*a*). A first terminal of the second capacitor C2 is connected to the first node A, and a second terminal thereof is connected to the input terminal D of the light-emitting unit 17.

When the circuit as shown in FIG. 3 is in the phase S1 of FIG. 1(*b*), and the circuit as shown in FIG. 4 is in the phase S1 of FIG. 2(*b*), the second capacitor C2 is configured to store a voltage difference between the first node A and the input terminal D of the light-emitting unit 17. When the circuit as shown in FIG. 3 is in the phase S2 of FIG. 1(*b*), and the circuit as shown in FIG. 4 is in the phase S2 of FIG. 2(*b*), the second capacitor C2 is further configured to discharge when the data signal line Idata is reset by being connected to the second power supply voltage terminal Vss. When the circuit as shown in FIG. 3 is in the phase S3 of FIG. 1(*b*), and the circuit as shown in FIG. 4 is in the phase S3 of FIG. 2(*b*), the second capacitor C2 is further configured to charge by the first power supply voltage terminal Vdd via the first capacitor C1 when the light-emitting unit 17 emits light.

In the third and fourth embodiments, compensation for brightness reduction caused by aging of the light-emitting unit 17 can be realized by adding the second capacitor C2. In the light-emitting phase, i.e., phase S3, since the light-emitting unit 17 becomes aging as time goes, internal resistance of the light-emitting unit 17 increases, and the voltage of the input terminal D of the light-emitting unit 17 will increase, while the voltage difference stored by the second capacitor C2 used for storing the voltage difference between the first node A and the input terminal. D of the light-emitting unit 17 remains unchanged. Therefore, when the second switch transistor T2 is turned on, voltage values of the first node A and the second node B will increase. In this way, a driving current value output by the driving unit 13 to the light-emitting unit 17 through the fifth switch transistor T5 will increase.

In particular, an added voltage value of the input terminal D of the light-emitting unit 17 is Voled, and an added voltage value of the second node B is Vx. According to law of conservation of charge, the following can be obtained: $(Vx-Vdd)C1+(Vx-Voled-Vss)C2=(Vg-Vdd)C1+(Vg-Vss)C2$, where the left of the equation is the total quantity of charge during the light-emitting phase, the right of the equation is the total quantity of charge during the writing phase, C1 is a capacitance of the first capacitor, and C2 is a capacitance of the second capacitor. It can be derived from this formula that:

$$Vx = Vg + \frac{Voled * C2}{C1 + C2}.$$

it can be known according to the previous embodiment that $$Vg = Vdd + Vth + \sqrt{\frac{I}{K}},$$

thereby $$Vx = Vdd + Vth + \sqrt{\frac{I}{K}} + \frac{Voled * C2}{C1 + C2}.$$

Therefore, it can be derived that $$Vgs' = Vx - Vdd = Vth + \sqrt{\frac{I}{K}} + \frac{Voled * C2}{C1 + C2},$$

and further derived that $$Vgs' - Vth = \sqrt{\frac{1}{K}} + \frac{Voled * C2}{C1 + C2}.$$

At this time, the actual current flowing through the driving unit 13 is $$Ioled = K\left(\sqrt{\frac{I}{K}} + \frac{Voled * C2}{C1 + C2}\right)^2.$$

Thus, it can be seen that as the light-emitting unit 17 becomes aging, the value of Voled increases, and the value of Vgs'−Vth also increases, so that the value of the driving current output by the driving unit 13 to the light-emitting unit 17 via the fifth switch transistor T5 increases.

Herein, although the formula of the actual current holed flowing through the driving unit 13 still comprises the value K, a major determining factor for the holed is the current value I in the writing phase, and the effect of the value K on the Poled is very small. Therefore, when the pixel circuit is applied to a display apparatus, the brightness non-uniformity of the display apparatus caused by instability of the threshold voltage or mobility can be still improved to a certain extent.

Therefore, in the third and fourth embodiments, the value of the driving current output by the driving unit 13 to the light-emitting unit 17 via the fifth switch transistor T5 increases, so as to increase brightness of lights emitted by the light-emitting unit 17. Compared with the lights emitted by the aged light-emitting unit 17 in the prior art, the embodiment of the present disclosure would have an effect of enhancing brightness of displaying, which thus avoids from reducing the light emission efficiency and influencing the light-emitting effect due to the aging of the light-emitting unit 17 as time goes.

The circuit structure of the pixel circuit in the third embodiment as shown in FIG. 3 is basically the same as the circuit structure of the pixel circuit in the fourth embodiment as shown in FIG. 4. The only difference lies in that: in the third embodiment, the first scanning line and the second scanning line are two different separate signal lines, i.e., CL1 and CL2 respectively, wherein the timing of the CL2 may be different from or the same as that of the CL1; in the fourth embodiment, the first scanning line and the second scanning line are the same signal line, i.e., CL1.

Compared with the fourth embodiment, the advantage of the third embodiment is that whether the light-emitting unit 17 emits light can be controlled separately by controlling a gate potential of the second scanning line CL2, and even if the fifth switch transistor T5 is in a turn-on state at this time and the pixel circuit is in the light-emitting phase, the second scanning line CL2 can also be controlled to adjust light emission of the light-emitting unit, for the purpose of adjusting brightness and contrast. Compared with the third embodiment, an advantage of the fourth embodiment is that one scanning line is saved. Therefore, the fourth embodiment has an effect of simplifying the design.

Fifth and Sixth Embodiments

Figure 5A:
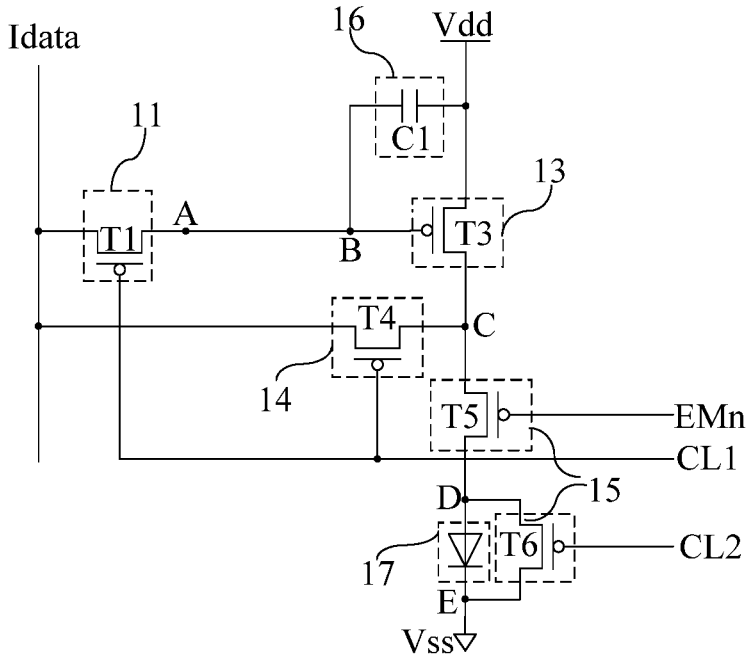
FIG. 5(*a*) shows an exemplary circuit structure diagram of a pixel circuit according to a fifth embodiment of the present disclosure.
Figure 5B:
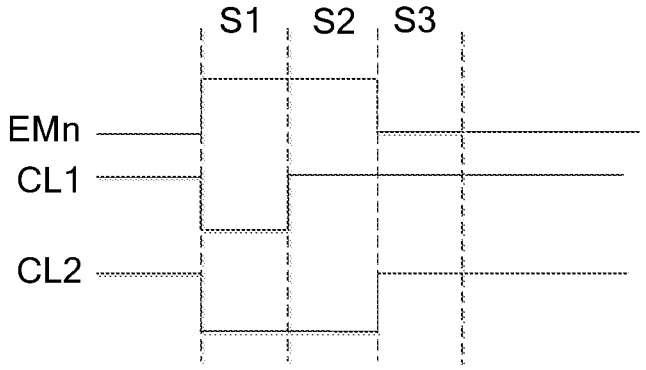
Figure 6A:
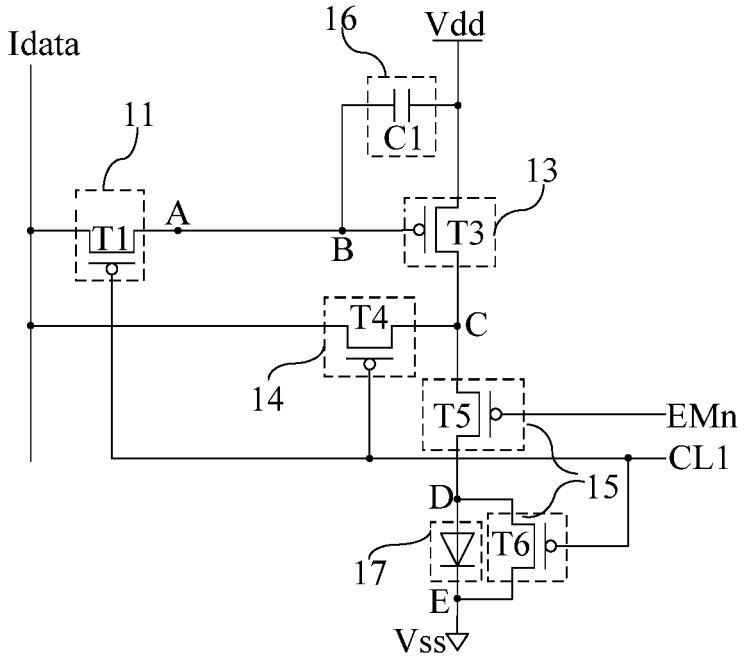
FIG. 6(*a*) shows an exemplary circuit structure diagram of a pixel circuit according to a sixth embodiment of the present disclosure.
Figure 6B:
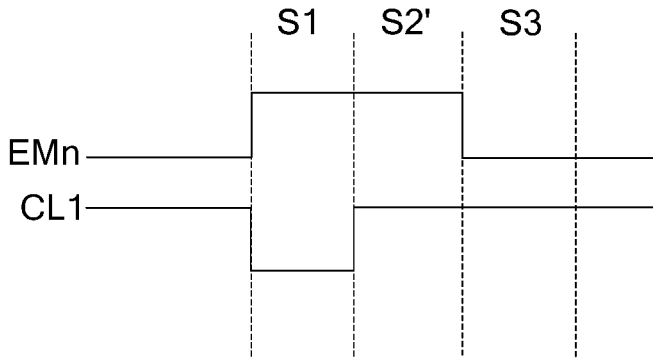

FIG. 5(*a*) and FIG. 6(*a*) show exemplary circuit structure diagrams of the pixel circuits in the fifth embodiment and the sixth embodiment of the present disclosure respectively.

The pixel circuits as shown in FIG. 5(*a*) and FIG. 6(*a*) each comprises: a data writing unit 11, a driving unit 13, a reset unit 14, a light-emitting control unit 15, a storage unit 16 and a light-emitting unit 17.

Compared with the pixel circuit in the first embodiment as shown in FIG. 1(*a*), the compensation unit 12 is not present in the pixel circuit of the fifth embodiment as shown in FIG. 5(*a*). Compared with pixel circuit in the second embodiment as shown in FIG. 2(*a*), the compensation unit 12 is not present in the pixel circuit of the sixth embodiment as shown in FIG. 6(*a*). Therefore, specific connection structures of the data writing unit 11, the driving unit 13, the reset unit 14, the light emission control unit 15, the storage unit 16 and the light-emitting unit 17 comprised in the pixel circuits in FIGS. 5(*a*) and 6(*a*) are not further described herein.

The operation timing of the pixel circuit as shown in FIG. 5(*a*) will be described below by referring to FIG. 5(*b*). In addition, the description will be provided below by taking all the switch transistors in FIG. 5(*a*) being P type transistors as an example. As well known by those skilled in the art, the P type transistor is turned on when its gate is input a high level.

During a phase S1 in FIG. 5(*b*), the first scanning line CL1 and the second scanning line CL2 are at a low level, and the fourth scanning line EMn is at a high level. The first switch transistor T1 is turned on under the control of the signal of the first scanning line CL1, and writes the data signal input by the data signal line Idata into the first node A. At this time, the first capacitor C1 stores a voltage difference between the data signal and the first power supply voltage terminal Vdd. The fourth switch transistor T4 is turned on under the control of the first scanning line CL1, and writes the data signal input by the data signal line Idata into the third node C. The fifth switch transistor T5 is turned off under the control of the third scanning line EMn−1. The sixth switch transistor T6 is turned on under the control of the second scanning line CL2, and connects the input terminal D of the light-emitting unit 17 to the second power supply voltage terminal Vss.

During a phase. S2' of FIG. 5(*b*), the second scanning line CL2 is at the low level, and the first scanning line CL1 and the fourth scanning line EMn are at the high level. The first switch transistor T1 is turned off under the control of the first scanning line CL1. The fourth switch transistor T4 is turned off under the control of the first scanning line CL1. The fifth switch transistor T5 is turned off under the control of the third scanning line EMn−1. The sixth switch transistor T6 is turned on under the control of the second scanning line CL2, and connects the input terminal D of the light-emitting unit 17 to the second power supply voltage terminal Vss.

During a phase S3 of FIG. 5(*h*), the first scanning line CL1 and the second scanning line CL2 are at the high level, and the fourth scanning line EMn is at the low level. The first switch transistor T1 is turned off under the control of the first scanning line CL1. The fourth switch transistor T4 is turned off under the control of the first scanning line CL1. The sixth switch transistor T6 is turned off under the control of the second scanning line CL2. The fifth switch transistor T5 is turned off under the control of the third scanning line EMn−1, and provides the light emission current output by the driving unit 13 to the input terminal D of the light-emitting milt 17, so as to make the light-emitting unit 17 emit light.

The above phase S2' serves as a buffer phase after the writing phase, i.e., the phase S1, and before the light-emitting phase, i.e., the phase S3, if there is no such buffer phase, i.e., after the writing phase S1, the EMn immediately becomes the low level and the CL1 and CL2 immediately become the high level, then it would cause that a potential of Vss may be directly poured into the data signal line Idata since competition is likely to exist in terms of timing. The phase S2' enables the first switch transistor T1 and the fourth switch transistor T4 to be turned off before the sixth switch transistor T6 is turned off, so as to achieve the effect of not influencing the data signal line Idata. In addition, in the phase S2', there is a reset for the anode of the light-emitting unit 17. A difference between writing of a current-type signal and writing of a voltage-type signal lies in that when the gate potential of the driving unit is written again, the next frame would not be influenced due to a stronger driving capability of the current driving IC than that of the voltage driving IC.

In the actual process of displaying, when the data signal input by the data signal line Idata is written into the second node B, that is, when the current on the data signal line Idata flows through the second node B, the driving unit 13 obtains a voltage value Vg. During the data writing phase, the voltage value Vg satisfies:

$$I = \frac{1}{2}\mu Cox\frac{W}{L}(Vg - Vdd - Vth)^2,$$

where I is a current written by the data signal line Idara, $$\frac{1}{2}\mu Cox\frac{W}{L}$$

can be considered as a constant K, Vth is a threshold voltage of the driving unit 13. During the light-emitting phase, $$Vg = Vdd + Vth + \sqrt{\frac{I}{K}},$$

and thus it can be derived that:

$$Vgs = Vg - Vdd = Vth + \sqrt{\frac{I}{K}}.$$

It can be known from the current formula $I=K(Vgs-Vth)^2$ that at this time, the current flowing through the light-emitting unit 17 is the current I written by the data signal line Idata, and thus it is unrelated to Vth and μ. That is, the current used for making the light-emitting unit 17 emit light is not influenced by the threshold voltage and mobility. If the pixel circuit is applied to a display apparatus, the phenomenon of brightness non-uniformity upon displaying of the display apparatus caused by instability of the threshold voltage or the mobility can be improved.

The circuit structure of the pixel circuit in the sixth embodiment as shown in FIG. 6(*a*) is basically the same as the circuit structure of the pixel circuit in the fifth embodiment as shown in FIG. 5(*a*), and thus no further details are provided herein. The only difference between the fifth embodiment and the sixth embodiment lies in that: in the fifth embodiment, the first scanning line and the second scanning line are two different separate signal lines, i.e., CL1 and CL2, respectively; in the sixth embodiment, the first scanning line and the second scanning line are the same signal line, i.e., CL1.

Compared with the sixth embodiment, an advantage of the fifth embodiment is that whether the light-emitting unit 17 emits light can be controlled individually by controlling a gate potential of the second scanning line CL2, and even if the fifth switch transistor T5 is in a turn-on state at this time and the pixel circuit is in the light-emitting phase, the second scanning line CL2 can also be controlled to adjust light emission of the light-emitting unit, for the purpose of adjusting brightness and contrast. Compared with the fifth embodiment, an advantage of the sixth embodiment is that one scanning line is saved. Therefore, the sixth embodiment has an effect of simplifying the design.

Since the operation timing of the pixel circuit in the sixth embodiment as shown in FIG. 6(*a*) is similar to the operation timing of the pixel circuit in the fifth embodiment as shown in FIG. 5(*a*), the operation timing of the pixel circuit in the sixth embodiment as shown in FIG. 6(*a*) is not further described herein.

Seventh and Eighth Embodiments

Figure 7:
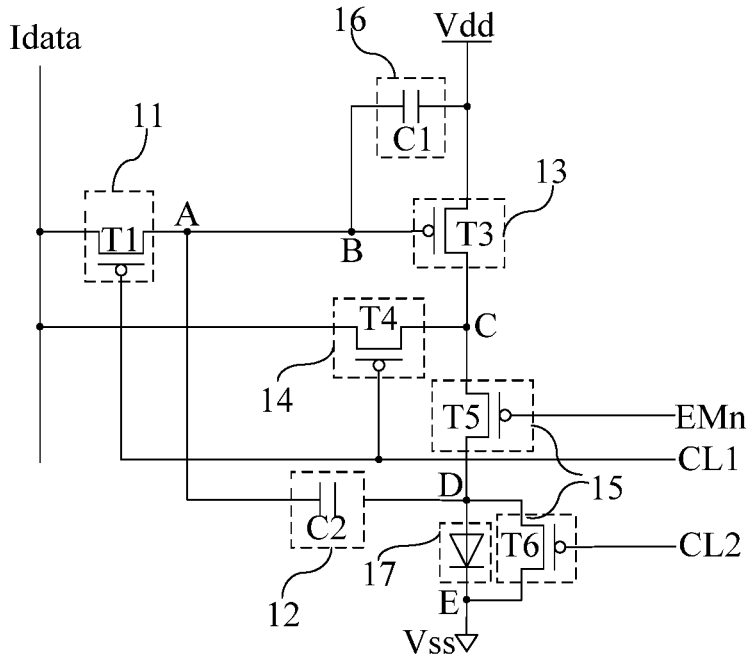
FIG. 7 shows an exemplary circuit structure diagram of a pixel circuit according to a seventh embodiment of the present disclosure.
Figure 8:
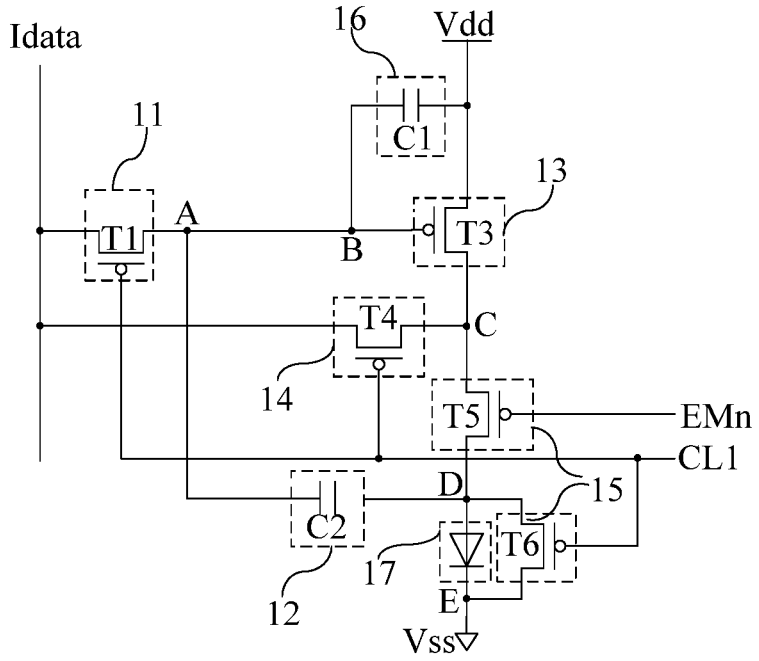
FIG. 8 shows an exemplary circuit structure diagram of a pixel circuit according to an eight embodiment of the present disclosure.

FIG. 7 and FIG. 8 show exemplary circuit structure diagrams of pixel circuits according to the seventh embodiment and the eighth embodiment of the present disclosure.

In particular, as shown in FIG. 7, the compensation unit 12 is added on the basis of the pixel circuit as shown in FIG. 5(*a*), and as shown in FIG. 8, the compensation unit 12 is added on the basis of the pixel circuit as shown in FIG. 6(*a*). The above compensation unit 12 comprises the second capacitor C2. A first terminal of the second capacitor C2 is connected to the first node A, and a second terminal thereof is connected to the input terminal D of the light-emitting unit 17. The second capacitor C2 is used for storing the voltage difference between the first node A and the input terminal D of the light-emitting unit 17. The second capacitor C2 is charged by the first power supply voltage terminal Vdd via the first capacitor C1 when the light-emitting unit 17 emits light.

It should be noted that, considering the first node A and the second node B are always connected without being cut off, potentials of both are always the same, and both the first capacitor C1 and the second capacitor C2 can store the voltage of the first node A, therefore, when the pixel circuit comprises the second capacitor C2, it may comprise or not comprise the first capacitor C1. When the pixel circuit comprises the first capacitor C1, if the sixth switch transistor T6 is suddenly turned on or suddenly turned off, then it is advantageous to reduce mistakes of switches. When the pixel circuit does not comprise the first capacitor C1, it is advantageous to reduce the design area of the circuit board.

In the seventh and eight embodiments, compensation for brightness reduction caused by aging of the light-emitting unit 17 can be realized by adding the second capacitor C2. In the light-emitting phase, i.e., phase S3, since the light-emitting unit 17 becomes aging as time goes, internal resistance of the light-emitting unit 17 increases, and the voltage of the input terminal D of the light-emitting unit 17 will increase, while the voltage difference stored by the second capacitor C2 used for storing the voltage difference between the first node A and the input terminal D of the light-emitting unit 17 remains unchanged. Therefore, a voltage value of the first node A (i.e., the second node B) will increase. In this way, a driving current value output by the driving unit 13 to the light-emitting unit 17 through the fifth switch transistor T5 will increase.

In particular, an added voltage value of the input end D of the light-emitting unit 17 is Voled, and an added voltage value of the second node B is Vx, Vx=Vg+Voled. It can be known from the previous embodiment that the written voltage value $$Vg = Vdd + Vth + \sqrt{\frac{1}{K}},$$

and thus it can be obtained that $$Vx = Vdd + Vth + \sqrt{\frac{I}{K}} + Voled,$$

thereby, $$Vgs' = Vx - Vdd = Vth + \sqrt{\frac{I}{K}} + Voled,$$

further be derived that $$Vgs' - Vth = \sqrt{\frac{I}{K}} + Voled.$$

Therefore, the actual current flowing through the driving unit 13 is $$Ioled = K\left(Voled + \sqrt{\frac{I}{K}}\right)^2.$$

Thus it can be seen that as the light-emitting unit 17 becomes aging, the value of Voled increases, and the value of Vgs'−Vth increases, so that the value of the driving current output by the driving unit 13 to the light-emitting unit 17 through the fifth switch transistor T5 increases.

Herein, although the formula of the actual current Ioled flowing through the driving unit 13 still comprises the value K, a major determining factor for the holed is the current value I in the writing phase, and the effect of the value K on the holed is very small. Therefore, when the pixel circuit is applied to a display apparatus, the brightness non-uniformity of the display apparatus caused by instability of the threshold voltage or mobility can be still improved to a certain extent.

Therefore, in the seventh and eight embodiments, the value of the driving current output by the driving unit 13 to the light-emitting unit 17 via the fifth switch transistor T5 increases, so as to increase brightness of lights emitted by the light-emitting unit 17. Compared with the lights emitted by the aged light-emitting unit 17 in the prior art, the embodiment of the present disclosure would have an effect of enhancing brightness of displaying, which thus avoids from reducing the light emission efficiency and influencing the light-emitting effect due to the aging of the light-emitting unit 17 as time goes.

The circuit structure of the pixel circuit in the seventh embodiment as shown in FIG. 7 is basically the same as the circuit structure of the pixel circuit in the eighth embodiment as shown in FIG. 8. The only difference lies in that: in the seventh embodiment, the first scanning line and the second scanning line are two different separate signal lines, i.e., CL1 and CL2 respectively, wherein the timing of the CL2 may be different from or the same as that of the CL1; in the eighth embodiment, the first scanning line and the second scanning line are the same signal line, i.e., CL1.

Compared with the eighth embodiment, the advantage of the seventh embodiment is that whether the light-emitting unit 17 emits light can be controlled separately by controlling a gate potential of the second scanning line CL2, and even if the fifth switch transistor T5 is in a turn-on state at this time and the pixel circuit is in the light-emitting phase, the second scanning line CL2 can also be controlled to adjust light emission of the light-emitting unit, for the purpose of adjusting brightness and contrast. Compared with the seventh embodiment, an advantage of the eighth embodiment is that one scanning line is saved. Therefore, the eighth embodiment has an effect of simplifying the design.

Exemplary circuit structures of the pixel circuit in eight embodiments of the present disclosure and operation timings are described in particular by referring to FIG. 1(*a*) to FIG. 8.

In addition, there is further provided a driving method of a pixel circuit. The pixel circuit comprises a data writing unit, a driving unit, a reset unit, a light emission control unit, a light-emitting unit and a storage unit.

The data writing unit is connected to a data signal line, a first scanning line and a first node, and configured to write a data signal input by the data signal line into a first node under a control of a first scanning signal of the first scanning line.

The reset unit is connected to the data signal line, the first scanning line and an output terminal of the driving unit, and configured to reset the data signal input by the data signal line and write the data signal into the output terminal of the driving unit, under a control of the first scanning signal.

The storage unit includes one terminal connected to a control terminal of the driving unit, and another terminal connected to an input terminal of the driving unit and a first power supply voltage terminal, and configured to store information on the data signal and transfer it to the control terminal of the driving unit.

The light emission control unit is connected to the output terminal of the driving unit, the light-emitting unit, a second scanning line, a third scanning line and a second power supply voltage terminal, and configured to write a second power supply voltage of the second power supply voltage terminal into the reset unit and provide a light emission current to the light-emitting unit to control it to emit light, under a control of a third scanning signal of the third scanning line.

The output terminal of the light-emitting unit is connected to the second power supply voltage terminal.

The driving method comprises:

a first phase, writing, to the driving unit, information on the data signal input by the data signal line;

a second phase, resetting the input terminal of the light-emitting unit;

a third phase, providing the light emission current to the light-emitting unit to control it to emit light.

In particular, the driving method applied to the pixel circuits of the first embodiment and the second embodiment of the present disclosure comprises:

a first phase, the data writing unit writes the data signal input by the data signal line into the first node under the control of the first scanning signal of the first scanning line; the compensation unit writes the data signal of the first node into the second node under the control of the fourth scanning signal of the fourth scanning line; the storage unit stores a voltage difference between the data signal and the first power supply voltage terminal; the reset unit writes the data signal input by the data signal line into the third node under the control of the first scanning signal of the first scanning line; the light emission control unit disconnects the third node from the input terminal of the light-emitting unit under the control of the third scanning signal of the third scanning line, and connects the input terminal of the light-emitting unit to the second power supply voltage terminal under the control of the second scanning signal of the second scanning line;

a second phase, the light-emitting control unit connects to the input terminal of the light-emitting unit to the second power supply voltage terminal under the control of the second scanning signal of the second scanning line, and connects the input terminal of the light-emitting unit to the third node under the control of the third scanning signal of the third scanning line; the reset unit connects the third node to the data signal line under the control of the first scanning signal of the first scanning line; the data writing unit writes a reset data signal of the data signal line into the first node under the control of the first scanning signal of the first scanning line; the compensation unit disconnects the first node form the second node under the control of the fourth scanning signal of the fourth scanning line;

a third phase, the data writing unit disconnects the data signal line from the first node under the control of the first scanning signal of the first scanning line; the reset unit disconnects the data signal line from the third node under the control of the first scanning signal of the first scanning line; the light emission control unit disconnects the input terminal of the light-emitting unit from the second power supply voltage terminal under the control of the second scanning signal of the second scanning line, and connects the input terminal of the light-emitting unit to the third node under the control of the third scanning signal of the third scanning line; the storage unit stores the potential of the second node; the compensation unit connects the first node with the second node under the control of the fourth scanning signal of the fourth scanning line; the driving unit outputs the light emission current to the light-emitting unit through the light emission control unit.

Further, the compensation unit of the pixel circuits according to the third and fourth embodiments further comprises the second capacitor C2.

The driving method applied to the pixel circuits of the third and fourth embodiments of the present disclosure further comprises: in the first phase, the second capacitor C2 stores the voltage difference between the data signal and the input terminal D of the light-emitting unit 17; in the second phase, the data signal line Idata is reset by being connected to the second power supply voltage terminal Vss, and the second capacitor C2 is discharged; in the third phase, the second capacitor C2 is charged by the first power supply voltage terminal Vdd via the first capacitor C1.

Additionally, the driving method applied to the pixel circuits of the fifth embodiment and the sixth embodiment of the present disclosure comprises:

a first phase, the data writing unit writes the data signal input by the data signal line into the first node under the control of the first scanning signal of the first scanning line; the storage unit stores the voltage difference between the data signal and the first power supply voltage terminal; the reset unit writes the data signal input by the data signal line into the third node under the control of the first scanning signal of the first scanning line; the light emission unit disconnects the third node from the input terminal of the light-emitting unit under the control of the third scanning signal of the third scanning line, and connects the input terminal of the light-emitting unit to the second power supply voltage terminal under the control of the second scanning signal of the second scanning line;

a second phase, the data writing unit disconnects the data signal line from the first node under the control of the first scanning signal of the first scanning line; the reset unit disconnects the data signal line from the third node under the control of the first scanning signal of the first scanning line; the light-emitting unit disconnects the third node from the input terminal of the light-emitting unit under the control of the third scanning signal of the third scanning line, and pulls down the input terminal of the light-emitting unit to the second power supply voltage of the second power supply voltage terminal under the control of the second scanning signal of the second scanning line;

a third phase, the data writing unit disconnects the data signal line from the first node under the control of the first scanning signal of the first scanning line; the reset unit disconnects the data signal line from the third node under the control of the first scanning signal of the first scanning line; the light emission control unit disconnects the input terminal of the light-emitting unit from the second power supply voltage terminal under the control of the second scanning signal of the second scanning line, and connects the third node to the input terminal of the light-emitting unit under the control of the third scanning signal of the third scanning line; the driving unit outputs the light emission current to the light-emitting unit via the light emission control unit.

Further, the compensation unit of the pixel circuits according to the seventh and eighth embodiments comprises the second capacitor C2.

The driving method applied to the pixel circuits of the seventh and eighth embodiments further comprises: in the first phase, the second capacitor C2 stores the voltage difference between the data signal and the input terminal D of the light-emitting unit 17; in the second phase, the data signal line Idata is reset by being connected to the second power supply voltage terminal Vss, and the second capacitor C2 is discharged; in the third phase, the second capacitor C2 is charged by the first power supply voltage terminal Vdd via the first capacitor C1.

There is further provided in the present disclosure a plurality of pixel circuits as described in any one of first to eight embodiments. The plurality of pixel circuits form a matrix including a plurality of rows and a plurality of columns, wherein the third scanning line of the pixel circuit in a present row in the matrix and the fourth scanning line of the pixel circuit in a previous row in the matrix are the same scanning line, for example, EMn−1.

Additionally, there is further provided in the present disclosure a display apparatus, comprising the pixel circuit as described in any one of the embodiments.

The display apparatus comprises a display panel. The display panel may be an OLED display panel. The OLED display panel comprises an array substrate and a package substrate. Herein, the array substrate can comprise TFT, an anode and a cathode electrically connected to a second electrode of the TFT, and an organic material functional layer located between the anode and the cathode.

The above descriptions are just specific implementations of the present disclosure, but the protection scope of the present disclosure is not limited thereto. Any alternation or replacement that can be conceived by those skilled in the art who are familiar with the technical field within the technical scope disclosed in the present disclosure shall fall into the protection scope of the present disclosure. Therefore, the protection scope of the present disclosure shall be subject to the protection scope of the claims.

What is claimed is:

1. A pixel circuit, comprising a data writing unit, a driving unit, a reset unit, a light emission control unit, a light-emitting unit and a storage unit, wherein, the data writing unit is connected to a data signal line, a first scanning line and a first node, and configured to write a data signal input by the data signal line into the first node under a control of a first scanning signal of the first scanning line;

the reset unit is connected to the data signal line, the first scanning line and an output terminal of the driving unit, and configured to reset the data signal input by the data signal line and write the data signal into the output terminal of the driving unit, under the control of the first scanning signal;

the storage unit includes one terminal connected to a control terminal of the driving unit, and another terminal connected to an input terminal of the driving unit and a first power supply voltage terminal, and is configured to store information on the data signal and transfer it to the control terminal of the driving unit;

the light emission control unit is connected to the output terminal of the driving unit, the light-emitting unit, a second scanning line, a third scanning line and a second power supply voltage terminal, and configured to, write a second power supply voltage of the second power supply voltage terminal into the reset unit and provide a light emission current to the light-emitting unit for controlling the light-emitting unit to emit light, under a control of a second scanning signal of the second scanning line and a third scantling signal of the third scanning one; and an output terminal of the light-emitting unit is connected to the second power supply voltage terminal.

2. The pixel circuit according to claim 1, further comprising a compensation unit, connected to the first node, the control terminal of the driving unit and a fourth scanning line, and configured to, write a voltage of the first node into the control terminal of the driving unit and compensate for the light emission current, under a control of a fourth scanning signal of the fourth scanning line.

3. The pixel circuit according to claim 2, wherein the compensation unit comprises a second switch transistor, whose gate is connected to the fourth scanning line, first electrode is connected to the first node, and second electrode is connected to the control terminal of the driving unit.

4. The pixel circuit according to claim 3, wherein the compensation unit is further connected to an input terminal of the light-emitting unit, and further comprises a second capacitor, whose first terminal is connected to the first node, and second terminal is connected to the input terminal of the light-emitting unit.

5. The pixel circuit according to claim 2, wherein the data writing unit comprises a first switch transistor, whose gate is connected to the first scanning one, first electrode is connected to the data signal line, and second electrode is connected to the first node.

6. The pixel circuit according to claim 2, wherein the storage unit comprises a first capacitor, whose first terminal is connected to the control terminal of the driving unit, and second terminal is connected to the input terminal of the driving unit and the first power supply voltage terminal.

7. The pixel circuit according to claim 2, wherein the driving unit comprises a third switch transistor, whose gate and first electrode are connected to two terminals of the storage unit respectively, and second electrode is connected to the reset unit and the light emission control unit.

8. The pixel circuit according to claim 2, wherein the reset unit comprises a fourth switch transistor, whose gate is connected to the first scanning line, first electrode is connected to the data signal line, and second electrode is connected to the output terminal of the driving unit.

9. The pixel circuit according to claim 2, wherein the light emission control unit comprises:

a fifth switch transistor, whose gate is connected to the third scanning line, first electrode is connected to the output terminal of the driving unit, and second electrode is connected to an input terminal of the light-emitting unit; and a sixth switch transistor, whose gate is connected to the second scanning one, first electrode is connected to the input terminal of the light-emitting unit, and second electrode is connected to the output terminal of the light-emitting unit.

10. The pixel circuit according to claim 2, wherein the first scanning line and the second scanning line are a same signal line or two different signal ones.

11. The pixel circuit according to claim 1, wherein the data writing unit comprises a first switch transistor, whose gate is connected to the first scanning line, first electrode is connected to the data signal line, and second electrode is connected to the first node.

12. The pixel circuit according to claim 1, wherein the storage unit comprises a first capacitor, whose first terminal is connected to the control terminal of the driving unit, and second terminal is connected to the input terminal of the driving unit and the first power supply voltage terminal.

13. The pixel circuit according to claim 1, wherein the driving unit comprises a third switch transistor, whose gate and first electrode are connected to two terminals of the storage unit respectively, and second electrode is connected to the reset unit and the light emission control unit.

14. The pixel circuit according to claim 1, wherein the reset unit comprises a fourth switch transistor, whose gate is connected to the first scanning line, first electrode is connected to the data signal line, and second electrode is connected to the output terminal of the driving unit.

15. The pixel circuit according to claim 1, wherein the light emission control unit comprises:

a fifth switch transistor, whose gate is connected to the third scanning one, first electrode is connected to the output terminal of the driving unit, and second electrode is connected to an input terminal of the light-emitting unit; and a sixth switch transistor, whose gate is connected to the second scanning line, first electrode is connected to the input terminal of the light-emitting unit, and second electrode is connected to the output terminal of the light-emitting unit.

16. The pixel circuit according to claim 1, wherein the first scanning line and the second scanning line are a same signal line or two different signal lines.

17. A driving method of the pixel circuit according to claim 1, comprising:

a first phase, writing the information on the data signal input by the data signal line into the driving unit;

a second phase, resetting an input terminal of the light-emitting unit;

a third phase, providing the light emission current to the light-emitting unit for controlling it to emit light.

18. The driving method according to claim 17, wherein the pixel circuit further comprises a compensation unit, and the driving method further comprises: hi the second phase, resetting the data signal input by the data signal line while resetting the input terminal of the light-emitting unit; in the third phase, compensating for the light emission current.

19. A driving circuit, comprising a plurality of pixel circuits according to claim 1, the plurality of pixel circuits forming a matrix, in which a third scanning line of a pixel circuit in a present row and a fourth scanning line of a pixel circuit in a previous row are a same scanning line.

20. A display apparatus, comprising the driving circuit according to claim 19.

* * * * *